350-432 SR
XR 4,030,790

United Stat[illegible] 11] 4,030,790
Williams et al. 45] June 21, 1977

[54] PROCESS FOR FABRICATING LENSES FOR MANUFACTURING CATHODE RAY TUBE SCREEN STRUCTURES

[75] Inventors: G. Norman Williams; Thomas W. Schultz, both of Seneca Falls, N.Y.

[73] Assignee: GTE Sylvania Incorporated, Stamford, Conn.

[22] Filed: Sept. 15, 1976

[21] Appl. No.: 723,233

[52] U.S. Cl. ..... 316/23; 350/189; 354/1

[51] Int. Cl.[2] ..... H01J 9/42

[58] Field of Search ..... 316/23, 29; 29/25.11, 29/25.17; 354/1; 350/178, 189, 211, 213, 320

[56] References Cited

UNITED STATES PATENTS

| | | | |
|---|---|---|---|
| 3,949,226 | 4/1976 | Dugan et al. | 354/1 X |
| 3,949,411 | 4/1976 | Yonai et al. | 354/1 |

*Primary Examiner*—Richard B. Lazarus
*Attorney, Agent, or Firm*—Norman J. O'Malley; Thomas H. Buffton; Robert T. Orner

[57] ABSTRACT

A process for fabricating lenses for use in manufacturing cathode ray tube screen structure wherein a matrix of data points is selected on the viewing screen of the cathode ray tube and a light source is positionally located at each of the data points by optical scanning exposure apparatus. The location information for each of the data points is recorded and a cathode ray tube is constructed having the screen structure fabricated in accordance with the recorded light source location information. Error between the light source location information and electron beam landing of the cathode ray tube is measured and the error measurements are utilized to correct the light source location information which is then submitted to a lens design program to furnish lens manufacturing information.

8 Claims, No Drawings

4030790
OR IN 316/23

PROCESS FOR FABRICATING LENSES FOR MANUFACTURING CATHODE RAY TUBE SCREEN STRUCTURES

CROSS REFERENCE TO OTHER APPLICATIONS

The following disclosures, concurrently filed June 23, 1976, relate to optical scanning exposure apparatus suitable to the fabrication of a cathode ray tube: Ser. No. 699,045 entitled "Control System For An Optical Scanning Exposure System For Manufacturing Cathode Ray Tubes" filed in the name of Thomas W. Schultz; Ser. No. 699,047 entitled "Scanning Rate And Intensity Control For Optical Scanning Apparatus" filed in the name of Thomas W. Schultz; Ser. No. 699,046 entitled "Exposure Area Control For An Optical Scanning System For Manufacturing Cathode Ray Tubes" filed in the name of Thomas W. Schultz; and Ser. No. 699,054 entitled "Overlap and Overscan Exposure Control System" filed in the names of Mahlon B. Fisher and G. Norman Williams each of these applications being assigned to the assignee of the present application.

BACKGROUND OF THE INVENTION

Cathode ray tube, and particularly color cathode ray tube manufacturing requires fabrication of a viewing screen structure, having a number of phosphor fields and usually a matrix of opaque material surrounding the phosphors and affixed to the inner surface. As is well known, the phosphor and matrix configuration are both intricate and precise requiring extensive controls, special apparatus, and knowledge in order to provide an acceptable commercial product.

At present, the most common practice for designing lens structures for color cathode ray tubes of the so-called "shadow mask" type includes the selection of a number of "shadow mask" coordinates. A light source is directed through a flat glass surface toward the "shadow mask" to print a phosphor field on the panel or viewing screen.

The viewing screen with the affixed phosphors has a plurality of data points and is fabricated into a color cathode ray tube. A measurement is made of the mislanding or deviation of electron beam landing from the phosphors at the data points. Then, a lens surface is calculated to provide proper beam landing at the data point coordinates.

A lens is constructed from the information provided and utilized, with a light source, to construct a viewing panel having phosphor locations as determined by the lens system. The viewing panel is fabricated into a cathode ray tube and a measurement of mislanding or deviation of electron beam landing from the data points is again made. This information is employed to calculate a new lens surface for effecting a proper beam landing and another new lens fabricated for use in manufacturing a color cathode ray tube. Moreover, the process is repeated until a lens is suitable to the fabrication of acceptable viewing screens for cathode ray tubes is produced.

Although the above-described cathode ray tube lens fabricating process has and still does provide readily marketable color cathode ray tubes and lenses for fabricating the color cathode ray tubes, it has been found that the process leaves something to be desired. More specifically, it has been found that the above-described lens fabricating process is relatively slow in that each iterative design requires a new lens fabrication at a considerable cost in time, labor, and materials.

OBJECTS AND SUMMARY OF THE INVENTION

An object of the present invention is to reduce some and obviate others of the disadvantages of the prior art. Another object of the invention is to provide an enhanced process for fabricating lenses. Still another object of the invention is to improve the process for fabricating lenses utilized in the manufacture of cathode ray tube structures.

These and other objects, advantages and capabilities are achieved in one aspect of the invention by a lens fabricating process wherein a matrix of data points on the viewing screen of a cathode ray tube is selected, locational coordinates of optical scanning exposure apparatus are altered to effect light beam impingement of the data points, the altered locational coordinates are recorded, and a cathode ray tube is constructed in accordance with the altered locational coordinates of the optical scanning exposure apparatus.

The error of impingement of an electron beam of the cathode ray tube at the data points positioned in accordance with the altered locational coordinates is measured and the altered locational coordinates are varied in accordance with the errors. The resultant varied altered locational coordinates are applied to a lens design program to provide lens manufacturing information.

PREFERRED EMBODIMENT OF THE INVENTION

For a better understanding of the present invention, together with other and further objects, advantages and capabilities thereof, reference is made to the following disclosure and appended claims.

In a preferred embodiment, lenses suitable for use in manufacturing color cathode ray tubes are fabricated by a process which includes the utilization of optical scanning exposure apparatus. Such apparatus is fully set forth and described in detail in the previously-mentioned co-pending applications filed concurrently on June 23, 1976 and bearing Ser. Nos. 699,045; 699,046; 699,047 and 699,054.

Briefly, the optical scanning exposure apparatus includes a light source, such as a laser beam source for example, which is directed onto a beam deflector which includes positional locating means for directing the light beam toward a viewing screen of a cathode ray tube as desired. The apparatus also includes optical means for imaging the light beam at the viewing screen to effect impingement of the viewing screen by the light beam at a given angle and apparatus for scanning the deflected light beam over the area of the viewing screen in a predetermined pattern.

Additionally, the optical scanning exposure apparatus includes a system for controlling the operation of the apparatus. Herein, an information storage capability is provided for storing information representative of the angle at which the light beam is directed onto the viewing screen and the rate of movement of the light beam between adjacent points or locations on the viewing screen. Also, the control system includes an encoder for providing horizontal and vertical scan position information to the information storage device, a scan rate means for controlling scan rate of the light beam, and an angle of incidence control system for varying the angle at which the light beam strikes the viewing screen.

As to the lens fabricating process, a position matrix of data points is selected on the surface of a viewing screen or panel for a cathode ray tube. The position matrix is a series of pre-selected points covering and representing the entire surface of the viewing screen and gives a relative approximate description thereof. Preferably, a position matrix of about 600 data points is utilized with the optical scanning exposure apparatus as compared with about 60–80 data points in the conventional apparatus presently employed. Moreover, as disclosed in the above-mentioned applications, the optical scanning exposure apparatus has the capability of interpolating intermediate the selected data points to provide a more defined description of the viewing screen or panel surface.

After selecting the matrix of data points, the optical scanning exposure apparatus is altered to provide impingement by the light beam at each of the data points of the pre-selected matrix. As the light beam is directed to strike each of the data points, the light beam appears to emanate from a source plane or virtual area whereby the light beam lands at the given data point with purity.

As the light beam is shifted to impinge successive data points, the positional location of each of the data points is recorded by the optical scanning exposure apparatus. Thus, the optical scanning exposure apparatus provides a recording, via memory, printout on a teletype, punched tape or other known techniques, of the data points describing the surface of the viewing screen or panel utilized to fabricate a cathode ray tube.

Utilizing the above-mentioned positional locations of the data points recorded by the optical scanning exposure apparatus, a color cathode ray tube is fabricated. Therein, the phosphor fields and a matrix of opaque light-absorbing material disposed intermediate the elements of the phosphor fields are affixed to a viewing screen or panel in accordance with positional locations determined by the recorded data of the optical scanning exposure apparatus. The remainder of the cathode ray tube i.e. controlled electron beam sources are affixed to a funnel-like member which is attached to the viewing screen or panel in the usual manner to complete the structure. The completed cathode ray tube structure is activated, in a normal manner, to cause the electron beams to strike the elements of the phosphor fields.

Thereafter, the deviation from exact center impingement of the elements of the phosphor fields by the electron beam is measured. Such measurements are readily measured by light-sensing devices readily available in the market-place such as a four-quadrant photoelectric device for example. Alternately, a photographic technique may be employed and the electron beam impingement errors measured from the photograph.

The imingement errors are applied to the optical scanning exposure apparatus to vary the recorded altered positional location coordinates originally directed at the pre-selected data points on the surface of the viewing screen. The optical scanning exposure apparatus thus provides a positional location coordinate record wherein the positional locations have been altered and then varied to represent the correct location for effecting centered impingement of an element of a phosphor field by an electron beam of a cathode ray tube.

Also, it should be noted that the recorded variations of the altered positional locations may be utilized to repeat the fabrication of another cathode ray tube to verify the correctness of the result. Again, the error measurements are made and the variations applied to the recorded positional locations. Thus, improvements in the cathode ray tube manufacturing process can be repeatedly made until a desired level of purity is attained without having constructed a lens.

Once having arrived at the desired level of purity or the desired accuracy of impingement of the elements of the phosphor fields by the electron beams, the recorded positional location information is submitted to a lens design program. The lens design programs are known to cathode ray tube manufacturers and provide output information in a form suitable for submission to a manufacturer of lenses.

Finally, the lens manufacture fabricates the lens in accordance with the information provided. The lens is returned to the cathode ray tube manufacturer who utilizes the lens in manufacturing viewing screens or panels for color cathode ray tubes.

Thus, there has been provided a unique process for fabricating lenses suitable for use in manufacturing color cathode ray tubes. The process employs optical scanning exposure apparatus whereby information necessary to a proper lens configuration is obtained prior to the fabrication of a lens. Thus, the process contrasts sharply with prior processes of utilizing a plurality of lenses to provide information of sufficient accuracy to provide a corrected lens suitable for cathode ray tube manufacture.

Further, the process greatly decreases both time and cost of providing lens design information. Moreover, the elimination of multiple lens fabrication before reaching a desired level of acceptable compromise reduces both cost and time to a fraction of the cost and time of prior known processes.

While there has been shown and described what is at present considered a preferred embodiment of the invention, it will be obvious to those skilled in the art that various changes and modifications may be made therein without departing from the invention as defined by the appended claims.

We claim:

1. In manufacturing color cathode ray tube screen structures, a lens fabricating process utilizing optical scanning exposure apparatus having a positionally locatable light beam source comprising the steps of:

selecting a matrix of data points on the viewing screen of a cathode ray tube;

altering the positional location coordinates of said light beam source of said optical scanning exposure apparatus to effect light beam impingement at each of said data points;

recording said altered positional location coordinates of said optical scanning exposure apparatus;

constructing a cathode ray tube having a viewing screen structure with a field of phosphor elements fabricated in accordance with said altered position location coordinates of said optical scanning exposure apparatus;

measuring the error of impingement of an electron beam on said elements of said phosphor field at said viewing screen of said cathode ray tube;

varying said recorded altered positional location coordinates of said optical scanning exposure apparatus in accordance with said measured error of impingement; and submitting said varied positional location coordinates of said optical scanning exposure apparatus to a lens design program to provide lens manufacturing information.

2. The process of claim 1 wherein said steps of altering and recording the altered positional location of said optical scanning apparatus, constructing a cathode ray tube, measuring the error of impingement of an electron beam, and varying the recorded altered positional location coordinates are repeated at least once to provide information for submission to a lens design program.

3. The process of claim 1 wherein said cathode ray tube is a color cathode ray tube having a field of phosphor elements for each color and said steps of altering the positional location of said optical scanning exposure apparatus and recording said altered positional location coordinates are repeated for each of the colors of the cathode ray tube.

4. The process of claim 1 wherein said cathode ray tube is a color cathode ray tube and said step of altering the positional location coordinates of said optical scanning exposure apparatus is repeated to provide fields of phosphor elements representative of each color and a matrix of opaque, light absorbing material surrounding the phosphor elements of the color cathode ray tube.

5. The process of claim 1 wherein said step of altering the positional location coordinates of said optical scanning exposure apparatus to effect light beam impingement of each of said data points includes the step of interpolating intermediate said matrix of data points to provide increased detail of the surface of said viewing screen.

6. In a cathode ray tube fabricating process wherein a lens is employed to direct a light beam from a light source through the apertures of a mask spaced from a layer of photosensitive material affixed to the inner surface of a viewing screen, a lens fabricating process utilizing optical scanning exposure apparatus having a positionally locatable light beam source comprising the steps of:

selecting a matrix of data points on the surface of the viewing screen of a cathode ray tube;

adjusting said optical scanning exposure apparatus to effect light beam impingement at each of said data points;

recording the positional information of said scanning exposure apparatus for effecting said light beam impingement of each of said data points;

fabricating a cathode ray tube with a viewing screen having at least one field of phosphors affixed in accordance with said recorded positional information of said optical scanning exposure apparatus;

measuring the deviation of impingement of an electron beam of said cathode ray tube on said field of phosphors at the viewing screen of said cathode ray tube;

altering the recorded positional information of said optical scanning exposure apparatus in accordance with said measured deviation of impingement of said electron beam; and applying the altered recorded positional information of said optical scanning exposure apparatus to a lens design program to provide manufacturing information suitable to lens fabrication.

7. The process of claim 6 wherein said step of fabricating a cathode ray tube includes the steps of providing a field of phosphor elements for at least three color phosphors and a matrix of light-absorbing material surrounding the elements of the field of phosphors.

8. The process of claim 6 wherein said steps of adjusting said optical scanning exposure apparatus, recording the positional information, fabricating a cathode ray tube, measuring the deviation of impingement of an electron beam, and altering the recorded positional information of said optical scanning exposure apparatus are repeated whereby electron and light beam impingement deviations are reduced.

* * * * *

UNITED STATES PATENT AND TRADEMARK OFFICE

CERTIFICATE OF CORRECTION

PATENT NO. : 4,030,790

DATED : June 21, 1977

INVENTOR(S) : G. NORMAN WILLIAMS and THOMAS W. SCHULTZ

It is certified that error appears in the above-identified patent and that said Letters Patent are hereby corrected as shown below:

| | |
|---|---|
| Col. 3, line 28 | After "techniques," and Before "of the data" insert --of the positional location of each--. |
| Col. 3, line 56 | DELETE "imingement" and insert --impingement--. |

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*